United States Patent [19]

Walworth

[11] 3,941,600

[45] Mar. 2, 1976

[54] METHOD OF FORMING A PHOTOGRAPHIC EMULSION LAYER

[75] Inventor: Vivian K. Walworth, Concord, Mass.

[73] Assignee: Polaroid Corporation, Cambridge, Mass.

[22] Filed: July 27, 1973

[21] Appl. No.: 383,262

[52] U.S. Cl. ..... 96/80; 96/94 R; 96/100; 96/107; 96/108; 96/113; 96/114; 96/114.7; 96/118; 423/34

[51] Int. Cl.[2] ..... G03C 1/84; G03C 1/02

[58] Field of Search ..... 117/34; 96/94 R, 94 BF, 96/80, 113, 114, 114.7; 423/23, 34, 491

[56] References Cited

UNITED STATES PATENTS

| | | | |
|---|---|---|---|
| 1,503,595 | 8/1924 | Mees | 96/95 |
| 3,000,741 | 9/1961 | De Pauw et al. | 96/94 R |
| 3,241,970 | 3/1966 | Popeck | 96/114 X |
| 3,511,662 | 5/1970 | Jouy | 96/94 R |
| 3,598,593 | 8/1971 | Klinger | 96/94 R |
| 3,600,175 | 8/1971 | Anderson | 96/94 R |
| 3,690,918 | 9/1972 | Miller | 96/94 BF |

*Primary Examiner*—Harry J. Gwinnell
*Assistant Examiner*—Stuart D. Frenkel
*Attorney, Agent, or Firm*—Philip G. Kiely

[57] ABSTRACT

Silver halide emulsion layers are formed by applying a water-soluble silver halide complex to a gelled substrate, and treating to decomplex to form silver halide crystals therein.

17 Claims, No Drawings

METHOD OF FORMING A PHOTOGRAPHIC EMULSION LAYER

BACKGROUND OF THE INVENTION

Photographic silver halide emulsions are generally prepared by precipitation of the silver halide in the presence of a carrier or binder, generally gelatin, wherein the silver halide crystals are formed by the interaction of a water-soluble silver salt, such as silver nitrate, and a water-soluble halide, such as potassium bromide. The term"crystal" as used herein refers to a crystalline particle of silver halide, sometimes referred to as a grain, and should be understood to include particles of any composition of silver halide with any mixture of crystal habits. Subsequent to the precipitation, the mixture is heated for a given period of time. Additional binder may be added at this point. The binder-silver halide mixture is then generally chilled, noodled and washed or flocculated and washed to remove the soluble salts. The mixture may again be melted, chilled and washed if desired. Various substances such as sensitizers, coating aids, and the like, may also be added to the emulsion during its preparation, generally after the washing stage, and a heat treatment may be applied to induce the process known as chemical sensitization. While gelatin is the most commonly used binder material for silver halide emulsions, other materials such as synthetic polymers are also employed. However, regardless of the particular binder employed, the emulsion making procedure generally is a lengthy and tedious operation involving fairly extensive equipment.

Copending application Ser. No. 311,690 filed Dec. 4, 1972 is directed to a method for forming a silver halide photographic emulsion which comprises forming a water-soluble silver halide complex and breaking the complex by, for example, dilution, to provide for the precipitation of silver halide crystals, preferably in the absence of a binder material, removing said silver halide crystals from the diluting medium and dispersing said silver halide crystals in a binder for coating on a support. The aforementioned application is incorporated by reference herein in its entirety.

SUMMARY OF THE INVENTION

The present invention is directed to a method for preparing a photographic silver halide emulsion layer which comprises imbibing a relatively thin layer of a permeable gelled substrate with a water-soluble silver halide complex and breaking the complex which results in the formation of the water-insoluble silver halide grains in the substrate. Decomplexation is achieved by dilution of the water-soluble complex by reaction with materials contained in the substrate.

The term "water-soluble silver halide complex" as used herein is intended to refer to mixtures of two or more complexes as well as a single complex.

DETAILED DESCRIPTION OF THE INVENTION

The present invention involves the formation of silver halide crystals in a pre-formed gelled binder layer or substrate from an inorganic, water-soluble silver halide complex. As stated above, such water-soluble silver halide complexes are known to the art. In contrast to grains of conventionally formed emulsions, the grains of the present invention are not the product of the precipitation of a water-soluble silver salt by a water-soluble halide. In other words, halides are not employed as the precipitant in the present invention. Such conventional procedures are generally carried out in the presence of a substantial amount of colloid binder material to provide an environment which permits the growth of the crystals. to the desired size and to prevent agglomeration of crystals during the growth process.

In the present invention, by depositing a fluid comprising a solution of a silver halide complex on a set gel medium, the soluble complex will diffuse substantially unidirectionally into the layer, forming a soluble silver halide layer, later decomplexed by dilution forming insoluble silver halide crystals by virtue of the depletion of the concentration of the silver halide complex and the attendant decomplexation. There is thus produced in the gelled layer what is essentially a monolayer of grains by virtue of the substantially unidirectional diffusion of the soluble complex. Grains of substantially uniform size are substantially uniformly distributed throughout the area of the layer by virtue of the uniformity of concentration depletion within the gelled layer.

The decomplexation of the water-soluble complex is accomplished by diluting the water solution of the complex in the set matrix which results in the formation of insoluble silver halide crystals which are held immobile a finite depth within the matrix. The specific degree of dilution will be determined by the rate at which the concentration of the water-soluble complex is lowered. The depth and the speed with which the precipitation of the silver halide crystals occurs depends upon the permeability and other properties of the gelled substrate including any adjuvants contained therein.

Having carried out the steps necessary to provide the precipitate, separation of the excess soluble salts is relatively easy. By washing the substrate with water, the undesirable solid material is removed without affecting the silver halide crystals or the substrate in which they are retained. The crystals may then be given any optional treatments desired such as those which will be discussed below, thereby providing a photographic silver halide emulsion layer in a relatively short period of time with a minimum of equipment and processing steps.

The novel process of the present invention is preferably carried out by forming a water-soluble complex of silver wherein the anion is chloride, bromide or iodide, or combinations thereof. For example, silver nitrate may be reacted with potassium bromide and/or calcium bromide to form silver bromide. Silver bromide solid is also commercially obtainable. The silver bromide is then added to a solution of a soluble bromide such as calcium bromide, lithium bromide or potassium bromide to produce silver bromide complex. The solution of the complex is preferably a saturated solution, but is is not critical that it be saturated. The thus-formed soluble complex is imbibed into a thin layer of a gelled substrate as by passing the layer through a tank containing the complex, or be coating the complex onto the layer by, e.g., curtain coating or other conventional technique. The relatively rapid change in the concentration of the complex as a result of the dilution by the substrate or by the application of a further diluent results in breaking the complex, forming water-insoluble silver halide crystals which precipitate and, by virtue of their insolubility, are retianed in situ. The excess complex salts which remain in solution are easily removed by passing the substrate through a wash tank or by flowing a stream of water over the substrate.

The halide salts which remain in solution subsequent to decomplexation can be recycled for use in forming new water-soluble silver halide complex. Thus, very little waste of materials is involved providing ecological and economic advantages to the process of the present invention.

In a particularly preferred embodiment, the complex solution is formed at an elevated temperature to provide optimum solubility of the complex. the dilution is carried out at a lower temperature to provide enhanced yield of silver halide precipitate.

Any natural or synthetic polymeric material conventionally employed in silver halide emulsion preparation may be employed in the present invention. Preferably, gelatin is employed. The term "gelled" as used herein refers to the solid state of the binder colloid as it is customarily found in conventional negatives.

Other suitable binder colloids include natural and/or synthetic polymeric material such as albumin; casein; or zein; or resins such as a cellulose derivative, as described in U.S. Pat. Nos. 2,322,085 and 2,541,474; vinyl polymers such as described in U.S. Pat. Nos 2,253,078; 2,276,322; 2,276,323; 2,281,703; 2,310,223; 2,311,058; 2,311,059; 2,414,208; 2,461,023; 2,484,456; 2,538,257; 2,579,016; 2,614,931; 2,624,674; 2,632,704; 2,642,420; 2,678,884; 2,691,582; 2,725,296; 2,753,264; and the like.

By means of the present invention, silver halide emulsion layers can be continuously and rapidly formed and incorporated into film units. For example, a continuous layer of set gelatin of a predetermined thickness suitable for employment as a photographic layer may be moved past a coating station where a thin layer of fluid containing a water-soluble silver halide complex is deposited on the surface. The fluid will permeate the layer forming the silver halide grains as described above. The layer may then be washed to remove any excess reagents or by-products, treated with chemical and/or spectral sensitizers, further treated with conventional hardeners and then incorporated into a film unit. Alternatively, a temporary support may be employed as a carrier for the gelled layer in which the silver halide grains are formed. It will be seen, therefore, that a relatively rapid, simple and continuous process employing a minimum of materials and equipment can produce silver halide emulsions.

In an alternative embodiment, the substrate may be pre-treated to provide varying degrees of permeability, for example, by incorporating porosity enhancing materials or hardening agents. In addition, various materials known to the art may be incorporated therein, such as buffers, nucleating particles, dye developers, couplers, antifoggants, stabilizers, and other reagents conventionally disposed in silver halide emulsions. Sensitization may be carried out by depositing chemical or spectral sensitizers in the gelled substrate prior to imbibing with the soluble complex, with the diluting medium, or subsequent to crystal formation. While the process has been defined primarily in terms of a single material comprising the polymeric substrate, it should be understood that the substrate may be composed of a combination of two or more polymers, natural or synthetic, which may be selected to provide a given set of properties. A latex may also be employed, alone or in combination with other polymers or a latex which might also regulate disposition of the complex and subsequent grain formation. Surfactants and humectants may also be advantageously employed to achieve the desired rate of cyrstallization.

While dilution is the preferred method of decomplexation, it should be understood that other conventional methods of crystallization may be employed such as temperature change, evaporation, nucleation and combinations of such conditions.

By means of the present invention, a variety of crystal sizes may be produced. In a preferred embodiment, the system is free of particulate material; however, in order to hasten the precipitation, which will result in finer crystals, it may be desirable to provide nucleating material to the diluting medium. The nucleating material may comprise substantially any particulate material, that is, an insoluble substance of a size smaller than the desired grain size. The specific material chosen is not critical. As examples of a suitable particulate nucleating material, mention may be made of gold sulfide, colloidal gold, silver iodide, colloidal silver, and colloidal silver bromide.

In the preferred embodiment, a halide salt is added to the gelled substrate prior to decomplexation, thereby modulating the rapidity with which the complex is broken and crystal formation occurs. If the halide in the substrate is the same as the halide in the complex, crystal formation will be slowed, resulting in relatively large grain formation. If a halide other than the halide in the complex is employed in the substrate and the halide in the substrate forms a less soluble silver halide than the halide of the complex, precipitation and crystal formation are accelerated, resulting in smaller silver halide crystals. In this situation, the breaking of the complex will be relatively rapid and complete, with the formation of a core of silver halide rich in the halide employed in the substrate. The less soluble silver halide (halide of the substrate) functions as a nucleus around which silver halide crystal (halide of the complex) forms. It should be understood that a combination of different halides at different ratios may be used in the substrate.

A particular advantage of the method of the present invention is that relatively uniform crystals of substantially any desired size from less than 0.1 micron to greater than a micron can be formed in a few minutes at room temperature by selecting the appropriate conditions. For example, in general, the higher the concentration of soluble halide in the substrate prior to crystallization, the larger the crystals that are produced. Conversely, the less soluble the halide in the substrate, the smaller the crystals produced. In this case the halide of the substrate and the halide of the complex are the same halide.

In employing a halide in the substrate, it has been found that a wide variety of compounds may be employed. As examples of suitable inorganic salts, mention may be made of the halides of potassium, lithium, sodium, rubidium, calcium, strontium, barium and ammonium. In addition to performing the desired modulation effect on the crystallization process, it has also been found that the employment of the aforementioned cations does not interfere with the photographic performance of the emulsion prepared from the silver halide crystals formed in the process of the present invention.

Silver halide crystal growth may be modified by compounds which absorb preferentially to specific faces of the crystal (see, for example, F. L. Claes et al., *Journal of Photographic Science*, Vol. 21, 1973, pages 39–50).

It has also been found that various organic solvents which are miscible with water may be employed in the substrate in order to provide various modifications to the silver halide crystal. As examples of solvents which may be employed, mention may be made of dimethyl sulfoxide, ethanol, 2-methoxy ethanol, acetone and dimethyl formamide.

A particularly preferred method within the scope of the present invention involves the employment of a soluble silver halide-ammonia complex which is imbibed into the layer. The ammonia is then allowed to evaporate resulting in the formation of insoluble silver halide grains.

It is known that color systems can be provided employing subtractive color procedures wherein the color providing materials are arrayed in the film unit in the form of a multiplicity of light sensitive elemental portions wherein the elemental portions are made up of at least two sets of elemental portions which are selectively sensitive, whereby the elemental portions of each set are exposable by light of a predetermined wavelength. The elemental portions are distributed over the support so as to be in contiguous relationship to form a pattern on the support, similar to those found in color screen rasters. For example, U.S. Pat. No. 2,983,606 discloses a multicolor photosensitive element wherein alternating strata of dye developers, i.e., dyes which are also silver halide developing agents, and associated silver halide emulsion segments are superimposed one over another to provide the aforementioned plurality of adjacent color providing segments.

By means of the present invention, a multicolor photosensitive element of the aforementioned type can be provided by means of a single treatment to incorporate the photosensitive silver halide within the layer comprising the multicolor element. For example, a series of elemental portions such as lines containing cyan, magenta and yellow dye developers, respectively, as well as the appropriate silver halide sensitizing dyes, disposed in a colloid binder material, can be applied to a support by conventional techniques known to the art and allowed to gel. One method which may be employed to provide such elemental portions is set forth in the U.S. Pat. No. 3,032,008. Subsequent to the deposition of the aforementioned screen array of dye developers and sensitizing dye, silver halide crystals may be formed within the substrate by applying the silver halide complex thereto as disclosed above. Thus, it would not be necessary to attempt to apply, in registration, the appropriately sensitized silver halide emulsion to correspond with a specific dye developer in a given elemental portion. Because the sensitizing dye has already been disposed in a permeable colloid binder with the proper dye developer, the silver halide emulsion layer may be formed throughout the entire dye developer-sensitizing dye containing gelled substrate. As the silver halide grains form in the layer, they will become associated with the sensitizing dye already located therein resulting in silver halide grains sensitized to the appropriate color, providing in a single layer the dye developer and the silver halide emulsion of the proper sensitivity to control the diffusion of the dye developer.

The following non-limiting examples illustrate the preparation of a silver halide emulsion layer within the scope of the present invention.

EXAMPLE

A saturated silver bromide solution was prepared by adding 1400 g. of lithium bromide to 650 ml. of water and cooling and to this solution was added 85 g. of silver nitrate dissolved in 100 ml. of water. The resulting mixture was cooled to room temperature and allowed to equilibrate for two hours. The supernatant liquid was decanted and filtered. A polyester support coated with 100 mg./ft.$^2$ of gelatin was immersed in the saturated silver bromide complex for one minute at room temperature, drained, dried and then washed with running water. Microscopy showed silver halide grains ranging from about 0.1 to 1.0 micron in diameter formed in the gelatin.

Care should be taken that the residence time of the gelled substrate in the solution of the complex is not excessive to avoid "salting out" of the polymers of the gel.

Since the crystals are formed in a relatively rigid environment by depletion of the concentration of silver halide complex, the crystals are relatively immobilized as soon as they are formed, thus substantially no agglomeration of crystals will occur resulting in an ordered, rather than a random, distribution of crystals in substantially a monolayer.

The silver halide crystals prepared by the present invention may be chemically sensitized by conventional chemical sensitizers known to the art, e.g., gold or noble metal sensitization, sulfur sensitization, such as by a labile sulfur compound, and reduction sensitization, i.e., treatment of the silver halide with a strong reducing agent. With regard to the use of chemical sensitizing agents, mention may be made of U.S. Pat. Nos. 1,574,944; 1,623,499; and 2,410,689.

The silver halide grains can also be treated with salts of the noble metals, such as ruthenium, rhodium, palladium, iridium and platinum. Representative compounds are ammonium chloropalladate, potassium chloroplatinate, and sodium chloropalladite, as described in U.S. Pat. Nos. 2,448,060; 2,566,245; and 2,566,263.

The silver halide grains can also be chemically sensitized with gold salts as described in U.S. Pat. Nos. 2,399,083 and 2,642,361. Suitable compounds are potassium chloroaurite, potassium aurothiocyanate, potassium chloroaurate, auric trichloride and 2-aurosulfobenzothiazole methochloride.

The silver halide grains can also be reduction sensitized with reducing agents, such as stannous salts as described in U.S. Pat. No. 2,487,850, polyamines, such as diethylene triamine as described in U.S. Pat. No. 2,518,698, polyamines, such as spermine as described in U.S. Pat. No. 2,521,925 or bis($\beta$-aminoethyl) sulfide and its water-soluble salts as described in U.S. Pat. No. 2,521,926.

Sensitizers of the solid semiconductor type, such as lead oxide, may also be employed. Such sensitizers are disclosed and claimed in copending U.S. applications Ser. Nos. 341,707 and 341,708, both filed Mar. 15, 1973.

The chemical sensitizers employed may be predisposed in the substrate prior to the crystal formation; in the soluble complex solution, in the diluting medium or in a subsequent solution for application to the grains.

Spectral sensitization of the silver halide crystals may be accomplished by contact of the crystal composition with an effective concentration of the selected spectral sensitizing dyes dissolved in appropriate dispersing solvent such as methanol, ethanol, acetone, water and the like; all according to the traditional procedures of the art, as described in Hamer, F. M., *The cyanine Dyes and Related Compounds*, or by pre-disposing the dye in the substrate prior to crystal formation. Alternatively, the dye may be employed in the water-soluble complex solution in the diluting medium.

Additional optional additives, such as coating aids, hardeners, viscosity-increasing agents, stabilizers, preservatives, and the like, also may be incorporated in the emulsion formulation prior to and/or subsequent to the formation of the grains. Materials for promoting adhesion between the layers may also be employed.

While the emulsions of the present invention have been described primarily in terms of diffusion transfer, it should be understood that substantially any type of photographic emulsion can be prepared, for example, photographic layers for negative development in liquid developers, reversal processing with either color couplers or black and white developers, direct positive emulsions, and the like.

What is claimed is:

1. A method for forming a photographic silver halide emulsion layer which comprises applying to a layer of gelled colloid binder material an aqueous solution of a water-soluble complex of silver halide complexed with excess halide and crystallizing photosensitive silver halide crystals by decomplexation of said silver halide complex within said gelled layer.

2. A method as defined in claim 1 wherein said solution is saturated.

3. A method as defined in claim 1 wherein said colloid binder material is a natural material.

4. A method as defined in claim 3 wherein said colloid binder material is gelatin.

5. A method as defined in claim 1 wherein said colloid binder material is a synthetic polymeric material.

6. A method as defined in claim 1 wherein said gelled layer includes an agent for modulating the crystallization of said silver halide crystals.

7. A method as defined in claim 1 wherein said gelled layer includes particulate material adapted to provide nucleating material for the formation of said silver halide crystals.

8. A method as defined in claim 6 wherein said gelled substrate includes a water-soluble halide salt disposed therein.

9. A method as defined in claim 8 wherein said water-soluble halide salt comprises the same halide as the halide of the water-soluble complex.

10. A method as defined in claim 1 wherein said complex is a saturated silver bromide complex.

11. A method as defined in claim 1 wherein said gelled layer is carried on a support.

12. A method as defined in claim 1 which includes the step of washing said silver halide emulsion layer.

13. A method as defined in claim 1 which includes the step of drying said silver halide emulsion layer.

14. A method as defined in claim 1 wherein a photographic sensitizing agent is disposed in said gelled layer prior to the application of said water-soluble complex.

15. A method as defined in claim 1 wherein a photographic sensitizing agent is applied to said gelled layer subsequent to said crystallization.

16. A process for forming a multicolor photosensitive element which comprises depositing on a substrate a multiplicity of elemental portions wherein each of said elemental portions comprises dye image-forming material and sensitizing dye disposed in a colloid binder material wherein said elemental portions are made up of at least two sets of elemental portions sensitive to light of different wavelengths, which elemental portions form a pattern which simulates a color screen type of pattern; gelling said binder material and imbibing into said gelled elemental portions an aqueous solution of a water-soluble complex of silver halide complexed with excess halide and crystallizing photosensitive silver halide crystals by decomplexation of said halide complex within said gelled layer.

17. The process as defined in claim 16 wherein said dye image-forming material is a dye developer.

* * * * *